US006709129B2

(12) United States Patent
Galli

(10) Patent No.: US 6,709,129 B2
(45) Date of Patent: Mar. 23, 2004

(54) DUAL MODE SWITCH MECHANISM FOR FLASHLIGHTS

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 42 days.

(21) Appl. No.: 10/378,538

(22) Filed: Mar. 3, 2003

(65) Prior Publication Data

US 2003/0198042 A1 Oct. 23, 2003

Related U.S. Application Data

(60) Provisional application No. 60/373,464, filed on Apr. 18, 2002.

(51) Int. Cl.[7] ..... F21L 4/00

(52) U.S. Cl. ..... 362/206; 362/205; 362/202

(58) Field of Search ..... 362/206, 205, 362/202, 184, 208

(56) References Cited

U.S. PATENT DOCUMENTS

| | | | | |
|---|---|---|---|---|
| ,762,720 | A | 6/1904 | Hubert | |
| 1,047,525 | A | 12/1912 | Hubert | |
| 1,436,340 | A | 11/1922 | Gallagher | |
| 1,866,600 | A | 7/1932 | Rauch | |
| 2,249,692 | A | 7/1941 | Gelardin | |
| 2,412,056 | A | 12/1946 | Mosch | |
| 2,465,114 | A | 3/1949 | Oury | |
| 2,591,112 | A | 4/1952 | Zwierzynski | |
| 2,714,152 | A | 7/1955 | Ackerman et al. | 562/116 |
| 2,762,907 | A | 9/1956 | Schwartz | |
| 2,889,450 | A | 6/1959 | Nordquist et al. | |
| 3,057,992 | A | 10/1962 | Baker | |
| 3,085,149 | A | 4/1963 | Giowsky | |
| 3,085,150 | A | 4/1963 | Bautsch | |
| 3,119,564 | A | 1/1964 | Zalman | |
| 3,256,428 | A | 6/1966 | Schwartz | |
| 3,296,429 | A | 1/1967 | Schwartz | |
| 3,310,668 | A | 3/1967 | Schwartz | |
| 3,345,508 | A | 10/1967 | Chung | |
| 3,359,411 | A | 12/1967 | Schwartz | |
| 3,613,414 | A | 10/1971 | Ostranger | |
| 3,732,414 | A | 5/1973 | Franc | 240/10.61 |
| 3,804,307 | A | 4/1974 | Johnston | 224/28 |
| 3,866,035 | A | 2/1975 | Richey, Jr. | 240/6.4 |
| 3,870,843 | A | 3/1975 | Witte | 200/302 |
| 4,076,976 | A | 2/1978 | Fenton | 362/104 |
| 4,085,315 | A | 4/1978 | Wolter et al. | 362/116 |

(List continued on next page.)

FOREIGN PATENT DOCUMENTS

GB 2 314 150 A 12/1997

OTHER PUBLICATIONS

Photon Micro–Light II and Hiyoshi Frosted–LED Lamp, 2001 Photon Light.

National Electrical Manufacturers Association: ANSI C79.1–1994, American National Standard.

Norme Internationale–International Standard–CEI iEC 60983, Second Edition Feb. 1995–02 Miniature lamps.

*Primary Examiner*—Laura K. Tso

(74) *Attorney, Agent, or Firm*—Barlow, Josephs & Holmes, Ltd.

(57) ABSTRACT

The present invention provides a unique dual mode, inline switch mechanism that is fully integrated into the rear cap of a flashlight assembly to provide a completely self contained and waterproof switching mechanism. The switch assembly further provides dual mode functionality including an ON position and a momentary ON position while also including a reliable OFF position that prevents the accidental activation of the light when the user desires that it remain off. The entire mechanism resides in the end cap of the flashlight assembly and includes an end cap structure that is designed to be rotatably attached to the end of a flashlight housing, a contact plate, a plunger and an elastomeric cover. The switch mechanism is fully integrated on the interior of the flashlight providing the highly desirable, fully contained, in line functionality.

11 Claims, 5 Drawing Sheets

U.S. PATENT DOCUMENTS

| | | | | |
|---|---|---|---|---|
| 4,101,955 | A | 7/1978 | DuNah | 362/104 |
| 4,122,510 | A | 10/1978 | Halliday, Jr. | 362/189 |
| 4,129,899 | A | 12/1978 | Dunbar | 362/109 |
| 4,210,953 | A | 7/1980 | Stone | 362/189 |
| 4,228,484 | A | 10/1980 | Johnstone | 362/184 |
| 4,261,026 | A | 4/1981 | Bolha | 362/101 |
| 4,276,582 | A | 6/1981 | Burnett | 362/116 |
| 4,303,966 | A | 12/1981 | Wolter | 362/116 |
| 4,336,574 | A | 6/1982 | Goodman | 362/101 |
| 4,346,329 | A | 8/1982 | Schmidt | 315/51 |
| 4,392,186 | A | 7/1983 | Cziment | 362/116 |
| 4,398,237 | A | 8/1983 | Doyel | 362/186 |
| 4,399,495 | A | 8/1983 | Leopoldi et al. | 362/189 |
| 4,408,261 | A | 10/1983 | Polakoff | 362/104 |
| 4,422,131 | A | 12/1983 | Clanton et al. | 362/186 |
| 4,433,365 | A | 2/1984 | Rousseau | 362/189 |
| 4,517,627 | A | 5/1985 | Bradford | 362/156 |
| 4,521,833 | A | 6/1985 | Wolter | 362/116 |
| 4,524,409 | A | 6/1985 | Yakubek | 362/189 |
| D285,989 | S | 10/1986 | MacDonald | D3/61 |
| 4,628,418 | A | 12/1986 | Chabria | 362/116 |
| D290,518 | S | 6/1987 | Rakocy et al. | D26/48 |
| 4,731,712 | A | 3/1988 | Amthor | 362/189 |
| 4,768,138 | A | 8/1988 | Leopoldi et al. | 362/189 |
| 4,787,016 | A | 11/1988 | Song | |
| 4,893,222 | A | 1/1990 | Mintzer | 362/109 |
| D311,067 | S | 10/1990 | Chabria | |
| 5,008,784 | A | 4/1991 | Wang | 362/116 |
| 5,029,055 | A | 7/1991 | Lindh | 362/191 |
| 5,043,854 | A | 8/1991 | Gammache | 362/197 |
| 5,122,943 | A | 6/1992 | Pugh | 362/256 |
| 5,143,442 | A | 9/1992 | Ishikawa et al. | 362/253 |
| 5,158,356 | A | 10/1992 | Guthrie | 362/188 |
| D337,200 | S | 7/1993 | Keller | |
| 5,285,586 | A | 2/1994 | Goldston et al. | 36/137 |
| 5,318,177 | A | 6/1994 | Isacson | 206/38.1 |
| D351,672 | S | 10/1994 | Tsay | D26/37 |
| 5,386,351 | A | 1/1995 | Tabor | 362/201 |
| 5,457,613 | A | 10/1995 | Vandenbelt et al. | 362/200 |
| 5,463,539 | A | 10/1995 | Vandenbelt et al. | 362/189 |
| 5,465,197 | A | 11/1995 | Chien | 362/203 |
| 5,475,368 | A | 12/1995 | Collins | 340/573 |
| 5,515,248 | A | 5/1996 | Canfield et al. | |
| 5,541,817 | A | 7/1996 | Hung | 362/116 |
| D372,356 | S | 8/1996 | Marguerite | D3/212 |
| D380,060 | S | 6/1997 | Chiang | D26/37 |
| 5,642,932 | A | 7/1997 | Matthews | 362/206 |
| D381,803 | S | 8/1997 | Crego | D3/208 |
| D392,402 | S | 3/1998 | Chen | D26/37 |
| 5,730,013 | A | 3/1998 | Huang | 70/395 |
| D394,345 | S | 5/1998 | Marguerie | |
| 5,772,309 | A * | 6/1998 | Groben | 362/183 |
| D400,326 | S | 10/1998 | Fisher | D32/42 |
| D401,371 | S | 11/1998 | Chen | D26/58 |
| D402,069 | S | 12/1998 | Chan | D26/38 |
| 5,893,631 | A | 4/1999 | Padden | 362/201 |
| 5,894,196 | A | 4/1999 | McDermott | 313/512 |
| 5,927,846 | A | 7/1999 | Sinclair | 362/152 |
| 5,934,789 | A | 8/1999 | Sinclair | 362/189 |
| 5,956,985 | A | 9/1999 | Chang | 70/456 |
| 6,006,562 | A | 12/1999 | Wolter | 70/456 R |
| D421,657 | S | 3/2000 | Siebert | D26/37 |
| 6,039,454 | A | 3/2000 | Hallgrimsson | 362/116 |
| 6,046,572 | A | 4/2000 | Matthews et al. | 320/116 |
| 6,070,990 | A | 6/2000 | Dalton et al. | 362/101 |
| 6,079,845 | A | 6/2000 | Kreider | 362/116 |
| D428,504 | S | 7/2000 | Saunders | D26/49 |
| 6,109,762 | A | 8/2000 | Hallgrimsson et al. | 362/200 |
| D434,164 | S | 11/2000 | Galli | D26/49 |
| 6,164,795 | A | 12/2000 | Lopez | 362/116 |
| 6,190,018 | B1 | 2/2001 | Parsons et al. | 362/116 |
| 6,222,138 | B1 | 4/2001 | Matthews et al. | 200/4 |
| 6,527,419 | B1 | 3/2003 | Galli | 362/308 |
| 6,530,672 | B2 | 3/2003 | Galli | 362/200 |
| 6,616,297 | B1 * | 9/2003 | Chen | 362/206 |

* cited by examiner

DUAL MODE SWITCH MECHANISM FOR FLASHLIGHTS

CROSS-REFERENCE TO RELATED APPLICATIONS

This application is related to and claims priority from earlier filed provisional patent application No. 60/373,464, filed Apr. 18, 2002.

BACKGROUND OF THE INVENTION

The present invention relates generally to a dual mode switch for improved functioning in flashlight devices. More specifically, the present invention relates to an improved pushbutton switching mechanism for flashlights that provides a momentary and constant ON feature as well as a positive, reliable OFF position.

Flashlights of varying sizes and shapes are generally well known in the art. A number of such designs are known that utilize two or more batteries as their source for electrical energy. Typically, these batteries are carried in series in a tubular body, where the tubular body also serves as a handle for the flashlight. In order to operate the flashlight, an electrical circuit is established from one terminal of the battery, through a conductor to an external switch located in an opening in the side of the tubular body and then through another conductor to one contact of a bulb. After passing through the filament of the bulb, the electrical circuit emerges through a second contact of the bulb in electrical contact with a conductor, which in turn is in electrical contact with the flashlight housing. Finally, the flashlight housing provides an electrically conductive path to the other terminal at the rear of the battery. Actuation of the external switch completes the electrical circuit selectively enabling electrical current to pass through the filament of the bulb, thereby generating light that is then typically focused by a reflector to form a beam of light.

In general, the above described flashlight switch mechanisms operate in two basic manners. The first method of operation is a pushbutton type switch on the side or bottom of the light. The user depresses the switch, which has an internal mechanism that locks in the engaged position, turning the flashlight on. To turn the light off, the user again depresses the switch, unlocking it and turning the light off. This design has several drawbacks. One drawback is that the increased number of parts creates additional assembly steps and increases the difficulty of assembly process. Another drawback is that when a flashlight of this type is stored in luggage, it is susceptible to being compressed by items that may shift during transit, thereby activating the flashlight and draining the battery. A further drawback associated with this possibility of accidental activation is evident in high intensity flashlights that generate a great deal of heat during operation. If a flashlight of this type is tightly packed in luggage and accidentally activated, it may cause a fire.

In an attempt to resolve the drawbacks noted above, with respect to the pushbutton type switches, a second type of rotatable switch was developed for in-line use in flashlights. In one design, an end cap is rotatably secured to the flashlight body. To establish the required electrical contact, the end cap is rotated making contact between the rear contact of the batteries and the housing of the flashlight thereby energizing the circuit and illuminating the lamp bulb. A number of such prior art designs feature rotatable end caps which are rotated to move the batteries longitudinally within the flashlight body towards the lamp bulb, thereby causing contact between the battery contact and the base contact of the lamp bulb. In the open position, the battery is typically spring biased away from the base contact of the bulb. In other designs, miniature flashlights have been designed where the rotatable switch is located in the reflector end of the flashlight body. The lamp bulb is located within an insulated receptacle at the reflector end of the flashlight with one or more conductive pins being rotatably aligned by movement of the switch portion of the device to establish electrical contact. While these switch mechanisms are internal to the device and thus less subject to damage, they are overly complicated in design thereby requiring higher assembly tolerances, which result in making them more costly to manufacture.

There is therefore a need for a unique flashlight switching design that provides dual mode functionality with a reliable OFF position that has improved functionality over the designs of the prior art. There is a further need for a flashlight switch device that requires a reduced number of parts thereby simplifying assembly and manufacture while providing the necessary dual mode functionality described above.

BRIEF SUMMARY OF THE INVENTION

In this regard, and in furtherance of the above stated objectives, the present invention provides a unique dual mode, inline switch mechanism that is fully integrated into the rear cap of a flashlight assembly to provide a completely self contained and waterproof switching mechanism. The switch assembly further provides a reliable OFF position that prevents the accidental activation of the light when the user desires that it remain off.

The flashlight of the present invention is constructed of primarily three sub assemblies including a flashlight head, a housing and an end cap. The entire basic structure of the switch of the present invention resides in the end cap of the flashlight assembly and includes an end cap structure that is designed to be rotatably attached to the end of a flashlight housing, a contact plate, a plunger and an elastomeric cover. Only the contact plate in the assembly of the present invention is required to be conductive. The end cap structure may be conductive so that its material is consistent with the material used in the outer housing of the flashlight however this is not required. The remaining components however are all electrically insulative and designed to properly isolate the conductive components to insure proper operation of the switch assembly. The plunger and contact plate are assembled and supported in an opening centrally located in the end cap. This provides for the plunger and contact plate to be located in a position at the rear of the flashlight where its motion is limited to a controlled and predictable linear travel. As can be seen, in this manner a switch assembly that operates in an in-line fashion is provided.

By limiting the travel of the plunger and contact plate to a predictable distance, the present invention can achieve the desired multifunctionality, namely, a momentary ON function, a full ON function and a verifiable OFF function. Each one of the functions is selected by rotating the end cap assembly including the switch of the present invention. As the end cap of the assembly is rotated, its linear spacing relative to the flashlight housing is increased or decreased thereby altering the mode of switch operation. In this manner an economical flashlight assembly is provided that has a reduced number of operational parts as compared to the prior art thereby producing a more reliable product.

The switch in the end cap further operates in conjunction with the spring element located in the head of the flashlight to further insure retention of the batteries and a positive electrical contact between the batteries and the head assembly. Further, the spring bias caused by the spring assembly in the head of the flashlight causes the batteries to be pressed rearwardly, which in turn causes the contact plate and plunger to be urged rearwardly creating the normally open bias for the switch assembly.

Accordingly, one of the objects of the present invention is the provision of a low cost flashlight having a superior dual mode switching mechanism. Another object of the present invention is the provision of a flashlight having a dual mode switching mechanism that includes a momentary ON, a full ON and a verifiable OFF position. A further object of the present invention is the provision of a flashlight having a dual mode switch that includes a reduced number of moving components thereby reducing manufacturing and assembly costs while improving the reliability of the assembly. Yet a further object of the present invention is the provision of a flashlight assembly having a dual mode switch that is integrated in an inline fashion and is waterproof.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
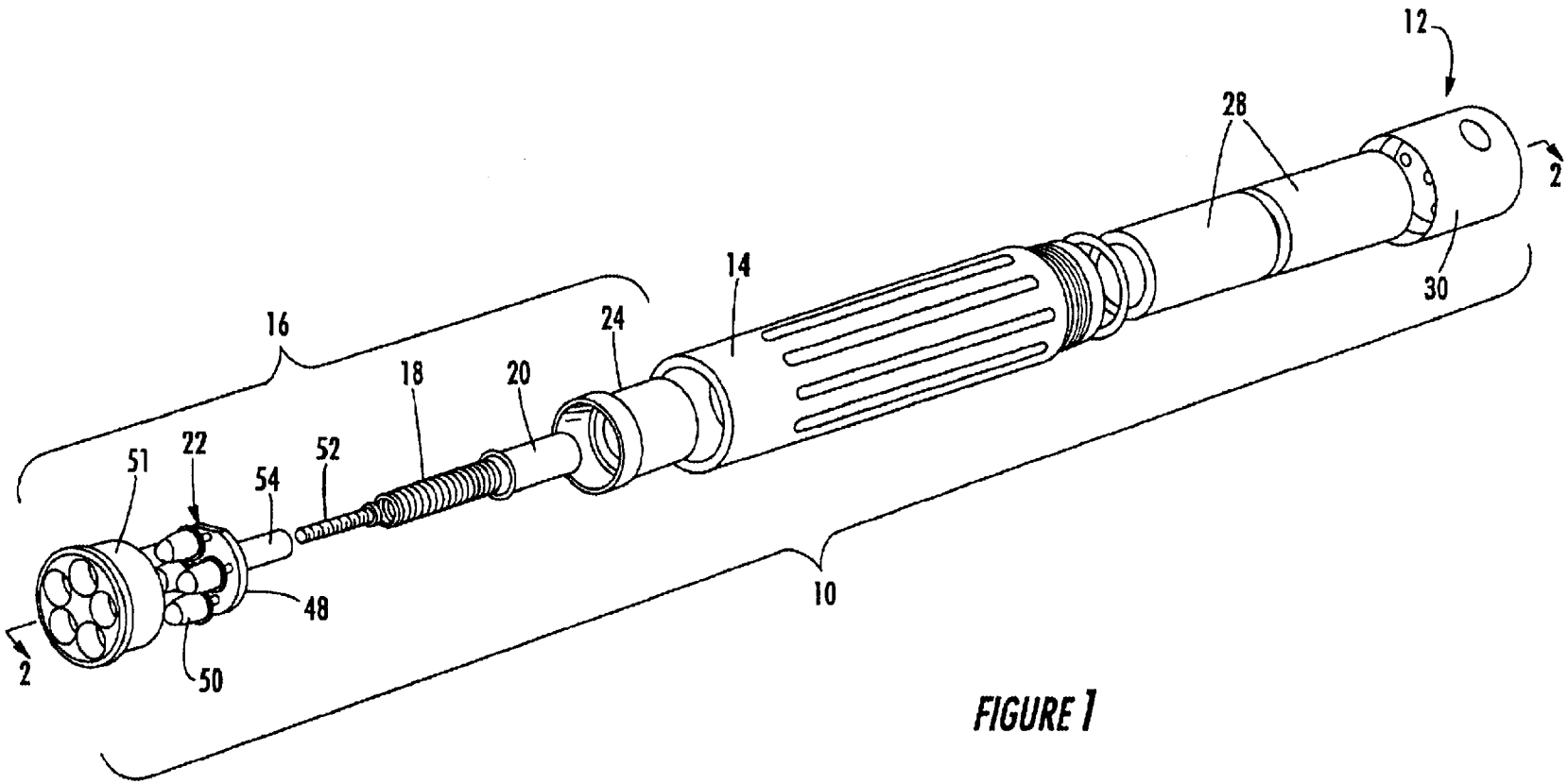
FIG. 1 is an exploded perspective view of a flashlight employing the dual mode switch assembly of the present invention.

Referring now to the drawings, a flashlight assembly including an end cap with the dual mode switch of the present invention is illustrated and generally indicated at 10 in FIGS. 1–7. In accordance with the present invention, an in-line flashlight 10 is provided having a momentary ON, full ON and confirmable OFF position. The flashlight 10 has three major components including an end cap 12, an outer housing 14 and a head assembly 16. When fully assembled the components interface with one another for form a novel and useful flashlight 10 that has previously been unknown in the art.

Figure 2:
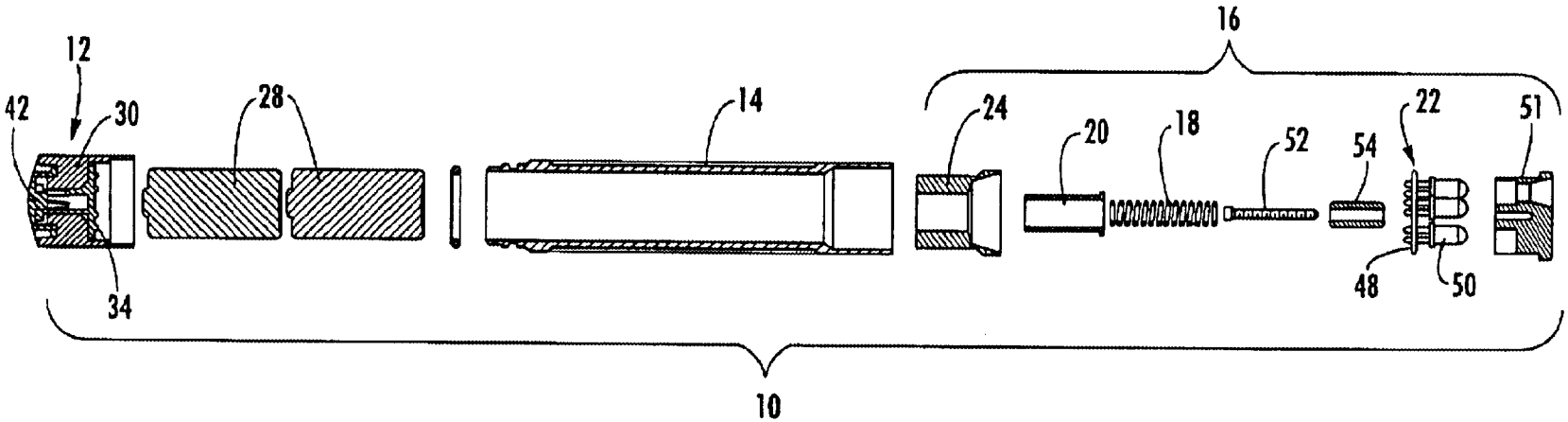
FIG. 2 is a cross-sectional view thereof taken along Line 2—2 of FIG. 1.

Turning to FIGS. 1 and 2 as a general overview, the flashlight 10 of the present invention has an outer housing 14 that is preferably electrically conductive, however, a circuit trace or contact wire may be installed in the outer housing 14 to serve as a path of conductivity in lieu of the outer housing 14. The head assembly 16 is press fit into one end of the housing 14 and the end cap 12 is threadedly received onto the other end of the outer housing 14 opposite the head assembly 16. The head assembly 16 further includes a spring 18 and plunger 20 that extends into the outer housing 14 and is in electrical communication with one contact of a lighting element 22 located within the head assembly 16. The second contact of the lighting element 22 is in electrical communication with the head assembly casing 24 and in turn with the wall of the outer housing 14. Batteries 28 are inserted into the outer housing 14 so that one end of the lower battery 28 is in electrical communication with the spring 18. The end cap 12 is threaded onto the outer housing 14 to retain the batteries 28. As can be seen, once the flashlight 10 is fully assembled, the batteries 28 are spring biased in a direction that exerts a force against the end cap 12.

Figure 3:
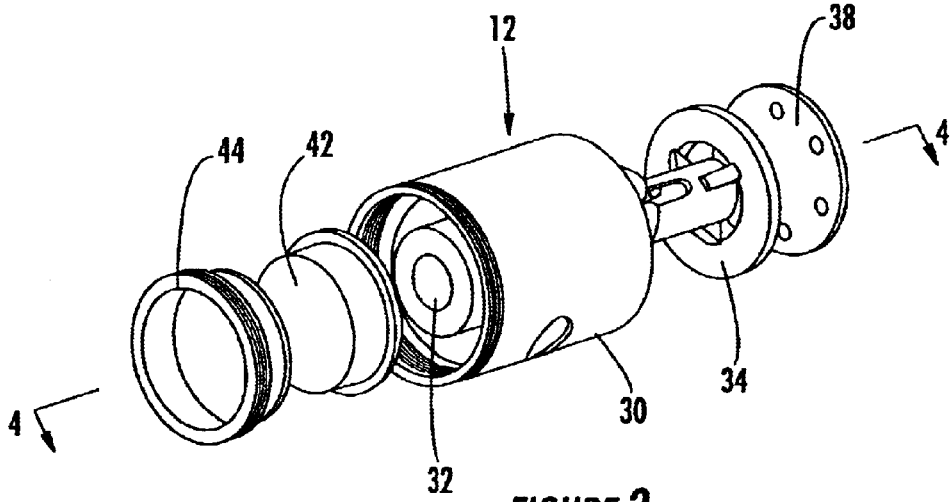
FIG. 3 is an exploded view of the end cap assembly thereof.
Figure 4:
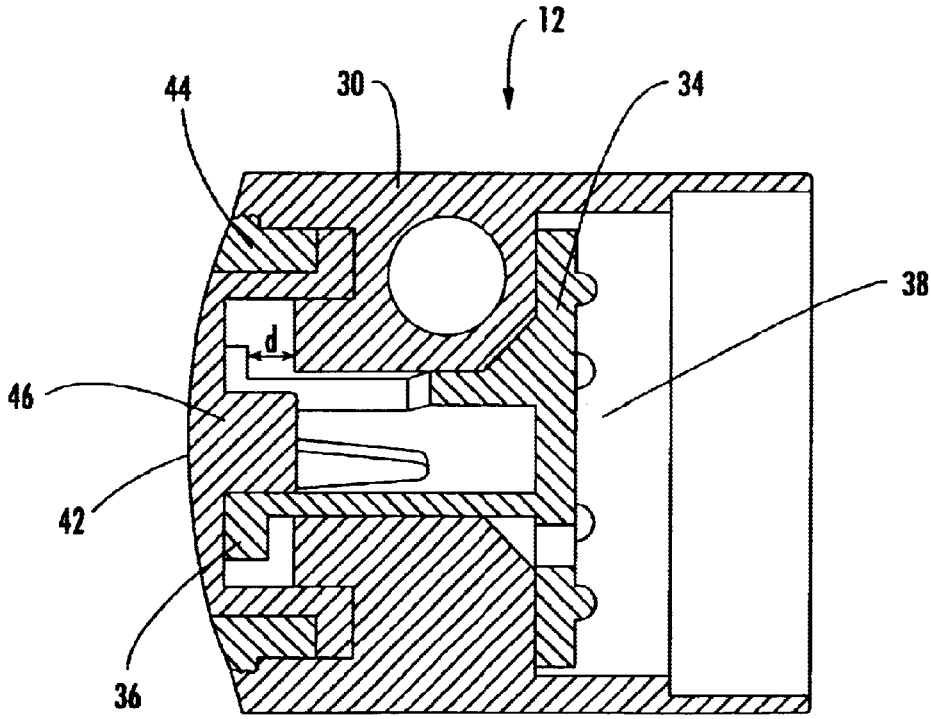
FIG. 4 is a cross-sectional view thereof taken along Line 4—4 of FIG. 3.

Turning now to FIGS. 3 and 4, detailed views of the several components of the end cap 12 are shown. The end cap 12 contains the operational elements of the switch assembly of the present invention and is threadedly received onto the end of the outer housing 14. The end cap 12 has a casing 30 that may or may not be constructed of electrically conductive material and includes an axial bore 32 through the center thereof. A plunger 34 is slideably received through the axial bore 32 in the casing 30 of the end cap 12. The plunger 34 is preferably a nonconductive material such as a molded plastic that has resilient material properties while serving to prevent any conduction of electricity through the plunger 34 and into the end cap 12 casing 30. Further, the plunger 34 has fingers 36 that contract allowing it to be inserted into the bore 32 within the cap 12 with clips on the end of the fingers 36 so that it remains in its assembled position when the flashlight 10 is disassembled for servicing the batteries 28. A switch plate 38 is installed on the bottom of the plunger 34. The switch plate 38 is a conductive metallic plate that is connected to the bottom surface of the plunger 34 either through the use of a fastener, an adhesive or through hot melting plastic pins 40 that integrally formed with and extend from the plunger 34 through openings in the switch plate 38. When fully assembled, the end cap 12 allows the switch plate 38 and plunger 44 to be slideably movable within the axial bore 32. However, the fingers 36 on the upper end of the plunger 34 serve to retain the plunger 34 within the bore 32, preventing it from falling out in addition to limiting the overall axial travel of the plunger 34. Once assembled, it can be seen that the travel of the switch assembly is limited to the distance "d" between the clips on the end of the fingers 36 on the plunger 34 and the sidewalls of the bore 32 in the end cap 12. The end cap 12 is then threaded onto the end of the outer housing 14 wherein the threaded portion engages the threaded end of the outer housing 14. An elastomeric cover 42 may be seated in the end of the cap 12 covering the switch plunger 34 and waterproofing the end cap 12 assembly. A retaining ring 44 is pressed into the end cap 12 after the elastomeric cover 42 is installed, retaining the elastomeric cover 42 in place. The elastomeric cover 42 may also include a tab 46 on the interior side that engages the fingers 36 of the plunger 34 preventing the fingers 36 from collapsing toward one another further retaining the plunger 34 in the endcap 12.

Figure 5:
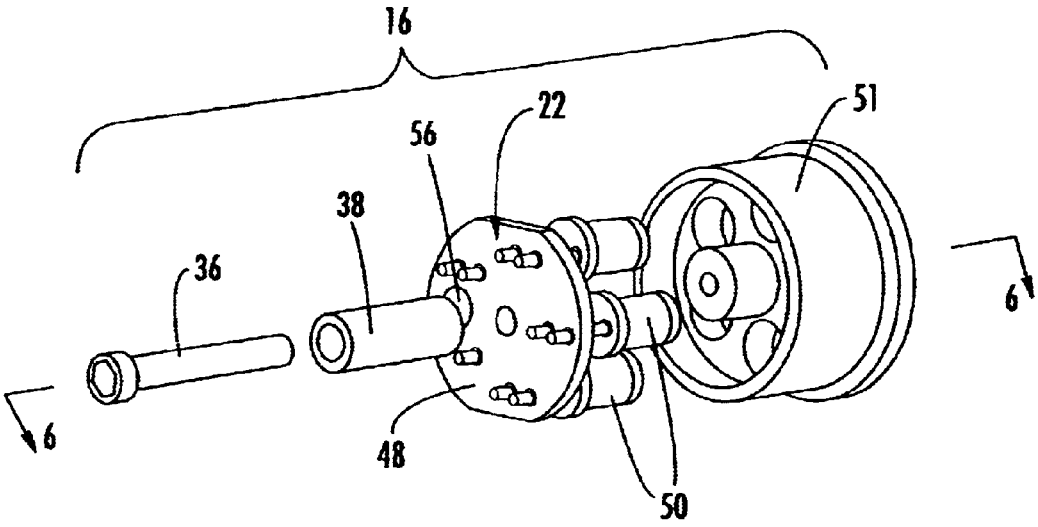
FIG. 5 is an exploded view of the head assembly thereof.
Figure 6:
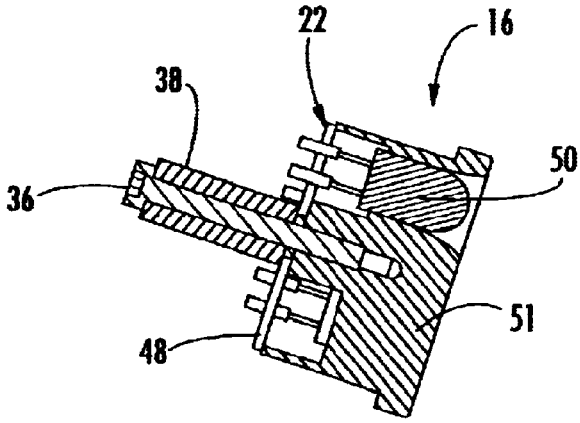
FIG. 6 is a cross-sectional view thereof taken along Line 6—6 of FIG. 5.

As is shown in FIGS. 5 and 6, the head assembly 16 of the flashlight 10 includes a lighting element 22 that is generally a mounting board 48 with light generating elements 50 mounted thereon. Preferably, the mounting board 48 is a circuit board having circuit traces and control electronics mounted thereto (not shown). Electrical connections with the light generating 50 elements are achieved as follows. First, a circuit trace is provided on the front surface of the board 48 that contacts the center of the flashlight head assembly 16. The head assembly 16 is conductive and is in turn in contact with the outer housing 14 providing a path for the positive DC current to flow. The negative DC pole of the battery 28 is in contact with a cap 20 that retains spring 18 when the batteries 28 are removed from the outer housing 14. The current is conducted along spring 18 to a circuit trace on the back of the board 48 thus providing the second point of electrical contact. The lighting assembly 22 is maintained in contact in its correct assembled position within the head 51 portion of the head assembly 16 with a long screw 52 that holds the board 48 in contact with the head 51. Further, screw 52 has a non-conductive sleeve 54 that acts as a guide for maintaining spring 18 in the proper operational position. An opening 56 is provided in the circuit board 48 to facilitate the injection of a sealing material between the circuit board 48 and the head 51 to form a water proof seal around all of the lighting elements 50 thereby preventing infiltration of water or other contaminants into the body of the flashlight 10. The sealing material may be any appropriate material such as an epoxy potting compound or a silicone sealant.

Figure 7A:
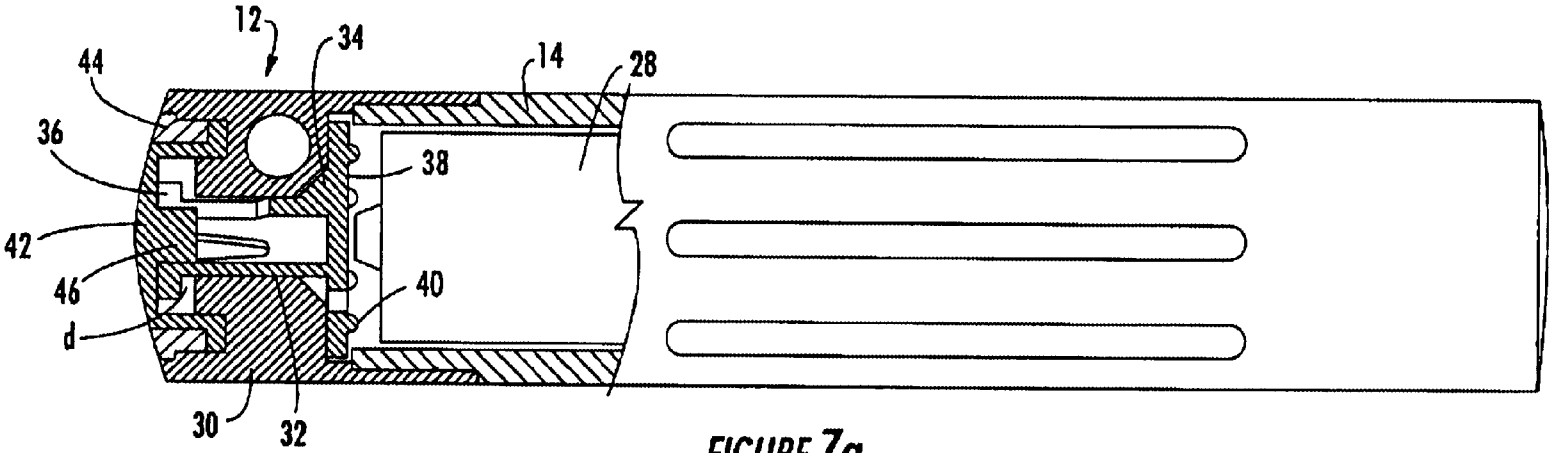
FIG. 7*a* is an enlarged cross-sectional view thereof in the ON position.
Figure 7B:
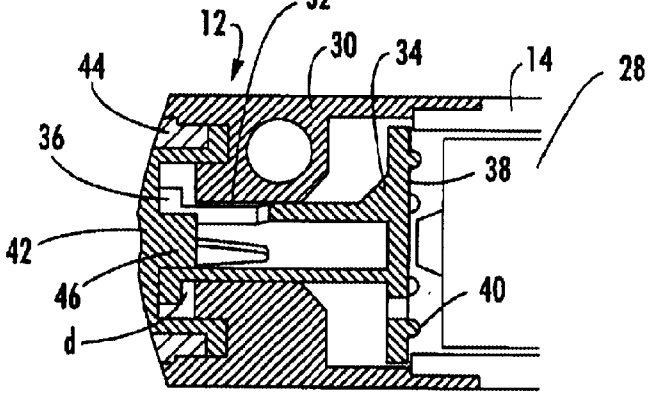
FIG. 7*b* is an enlarged cross-sectional view thereof in the momentary ON position.
Figure 7C:
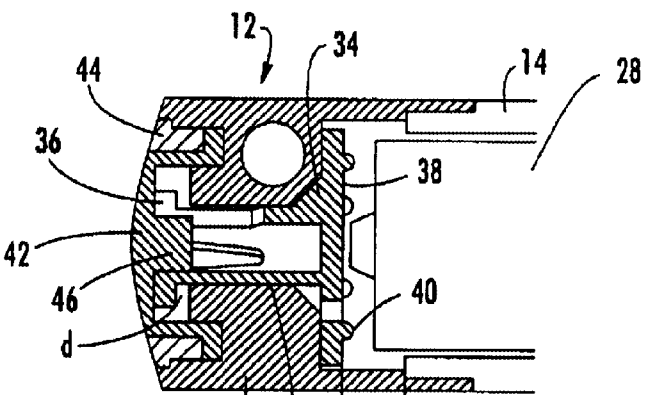
FIG. 7*c* is a cross-sectional view thereof in the OFF position.

Turning to FIGS. 7*a*–7*c*, the operational relationship between all of the fully assembled components is shown. In FIG. 7*a*, it can be seen that the batteries 28 are spring biased in a direction towards the rear of the outer housing 14 and towards the end cap 14. The second contact of the batteries 28 is in constant contact with the center of the switch plate 38. When the cap 12 is threaded onto the flashlight 10, it begins to press the batteries 28 downwardly into the outer housing 14. The batteries 28 further press upwardly causing the switch plate 38 to move into contact with the underside of the end cap casing 30. If the cap 12 is fully threaded onto the outer housing 14, the switch plate 38 comes into rigid contact with the end of the outer housing 14 energizing the flashlight circuit in a full "on" function. With the cap 12 only partially threaded onto the outer housing 14, as is shown in FIG. 7*c*, it can be seen that if the allowed travel distance (T) between the electrically conductive outer housing 14 and the switch plate 38 is greater than the maximum operable distance (d) of the switch assembly, the flashlight 10 remains "off" and cannot be energized by pressing the plunger 34 because the gap is too great to be overcome by the travel of the plunger 34. The limited travel of the switch is important in defining the function of the switch. In this position, the flashlight 10 is in a confirmed "off" position. When the cap 12 is further threaded onto the outer housing 14 as shown in FIG. 7*b* and the travel distance (T) between the switch plate 38 and the outer housing 14 is no longer greater than the operable limit (d) of the switch components, the switch can be depressed, pushing the batteries 28 downwardly, allowing the switch plate 38 to come into momentary contact with the outer housing 14 and momentarily energize the flashlight 10. If released, the batteries 28 push the switch back breaking the contact, thus providing a momentary "on" function.

The present invention also anticipates that the push button switch may be employed as one component in the switching and function selection on a flashlight 10. For example, in addition to using the switch of the present invention, a flashlight may also incorporate electronics and a selector switch to further selectively energize the flashlight in a strobe or signal code manner. This also allows the end cap 12 to be threaded on tightly under most operational circumstances. The end cap 12 would then be unthreaded slightly to produce the momentary "on" function. Further, the switch of the present invention may be incorporated in parallel or series with other switching mechanism as have been described.

It can therefore be seen that the present invention provides a novel integrated in line dual mode switch assembly that enhances the function of a flashlight device. The switch assembly provides an the desirable ON, momentary ON and confirmable OFF features in a flashlight having a reduced number of operational parts, thereby enhancing the reliability of the flashlight while reducing the manufacturing costs associated therewith. Further, the present invention can be modified to accommodate a number of different flashlight configurations to create a highly useful and versatile switch assembly. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A switch device for use in a flashlight comprising:

a housing having an electrical contact on a first end thereof and an outer wall defining an interior cavity;

at least one battery in said interior cavity, said battery being spring biased in a first linear direction towards said first end of said housing; and a slidable actuator threadedly received on said first end of said housing, said actuator being in electrical communication with said battery, said switch device having a fully closed position wherein said actuator is fully threaded onto said housing and said actuator is in electrical communication with said electrical contact, said switch device having a selectibly closed position wherein rotation of said actuator relative to said housing creates a space between said actuator and said electrical contact, said actuator being depressible in a second linear direction opposite said first causing said actuator to move into electrical communication with said electrical contact and said switch device having a fully open position wherein further rotation of said actuator relative to said housing causes said space between said actuator and said electrical contact to be greater than the allowable linear travel of said actuator preventing said actuator from contacting said electrical contact.

2. The switch device of claim 1, wherein said housing is electrically conductive.

3. The switch device of claim 1, said switch assembly further comprising:

an end cap threadedly received on said first end of said housing, said end cap having an annular opening therein; and an actuator having a head portion and a contact portion with a post extending therebetween, said head portion further including retention clips adjacent to said post, said post of said actuator being slidably received in said annular opening of said end cap; and a contact plate, said contact plate being electrically conductive and having a first contact surface and a second surface opposite said first surface, said second surface being attached to said contact portion of said post, said contact plate in electrical communication with one terminal of said battery, said switch device having a fully closed position wherein said switch assembly is fully threaded onto said housing and said contact plate is in electrical communication with said electrical contact, said switch device having a selectibly closed position wherein rotation of said switch assembly relative to said housing creates a space between said contact plate and said electrical contact, said actuator being depressible in a second linear direction opposite said first, causing said switch actuator to move said contact plate into electrical communication with said electrical contact and said switch device having a fully open position wherein further rotation of said end cap relative to said housing causes said space between said electrical contact and said contact surface to be greater than the space between said retention clips of said actuator and said end cap, contact of said retention clips with said end cap preventing said contact surface from contacting said electrical contact.

4. The switch device of claim 3, said switch assembly further comprising:

an elastomeric cover disposed in said end cap covering said actuator.

5. A switch device for use in a flashlight comprising:

a tubular housing having an electrically conductive outer wall, a first end and a second end, said outer wall defining an interior cavity;

at least one battery received in said interior cavity, said battery being spring biased in a first linear direction towards said first end of said housing;

an end cap threadedly received on said first end of said housing, said end cap having an annular opening therein;

an actuator having a head portion and a contact portion with a post extending therebetween, said head portion further including retention clips adjacent to said post, said post of said actuator being slidably received in said annular opening of said end cap; and a contact plate, said contact plate being electrically conductive and having a first contact surface and a second surface opposite said first surface, said second surface being attached to said contact portion of said post, said contact plate in electrical communication with one terminal of said battery, said switch device having a fully closed position wherein said contact surface is in electrical communication with said first end of said housing when said end cap is fully threaded onto said housing, said switch device having a selectibly closed position wherein rotation of said end cap relative to said housing creates a space between said first end of said housing and said contact surface, said contact surface being urged into electrical communication with said first end of said housing by pressing said actuator in a second linear direction opposite said first and said switch device having a fully open position wherein further rotation of said end cap relative to said housing causes said space between said first end of said housing and said contact surface to be greater than the space between said retention clips of said actuator and said end cap, contact of said retention clips with said end cap preventing said contact surface from contacting said housing.

6. The switch device of claim 5, said switch assembly further comprising:

an elastomeric cover disposed in said annular opening of said end cap, said elastomeric cover covering said actuator.

7. A flashlight assembly comprising:

a housing having an outer wall, a first end, a second end and an electrical contact on said first end thereof, said outer wall defining an interior cavity;

at least one battery in said interior cavity, said battery having a first contact and a second contact, said battery being spring biased in a first linear direction towards said first end of said housing;

a lighting element having first and second electrical contacts, said lighting element disposed in said second end of said housing, said first electrical contact in electrical communication with said electrical contact on said housing and said second electrical contact in electrical communication with said second contact of said battery; and a switch assembly including, an end cap threadedly received on said first end of said housing, said end cap having an annular opening therein;

an actuator having a head portion and a contact portion with a post extending therebetween, said head portion further including retention clips adjacent to said post, said post of said actuator being slidably received in said annular opening of said end cap, and a contact plate, said contact plate being electrically conductive and having a first contact surface and a second surface opposite said first surface, said second surface being attached to said contact portion of said post, said contact plate in electrical communication with one terminal of said battery, said switch device having a fully closed position wherein said contact surface is in electrical communication with said first end of said housing when said end cap is fully threaded onto said housing, said switch device having a selectibly closed position wherein rotation of said end cap relative to said housing creates a space between said first end of said housing and said contact surface, said contact surface being urged into electrical communication with said first end of said housing by pressing said actuator in a second linear direction opposite said first and said switch device having a fully open position wherein further rotation of said end cap relative to said housing causes said space between said first end of said housing and said contact surface to be greater than the space between said retention clips of said actuator and said end cap, contact of said retention clips with said end cap preventing said contact surface from contacting said housing.

8. The flashlight assembly of claim 7, wherein said housing is electrically conductive.

9. The flashlight assembly of claim 7, said switch assembly further comprising:

an elastomeric cover disposed in said end cap covering said actuator.

10. The flashlight assembly of claim 7 wherein said lighting element is a light emitting diode.

11. The flashlight assembly of claim 7 wherein said lighting element is an array of light emitting diodes.

* * * * *